US005406693A

United States Patent [19]

Egashira et al.

[11] Patent Number: 5,406,693

[45] Date of Patent: Apr. 18, 1995

[54] METHOD OF MANUFACTURING A HELICAL ANTENNA FOR SATELLITE COMMUNICATION

[75] Inventors: Yoshimi Egashira; Moriyoshi Kawasaki, both of Kanagawa, Japan

[73] Assignee: Harada Kogyo Kabushiki Kaisha, Tokyo, Japan

[21] Appl. No.: 87,168

[22] Filed: Jul. 2, 1993

[51] Int. Cl.[6] ..... H01P 11/00

[52] U.S. Cl. ..... 29/600; 343/895

[58] Field of Search ..... 29/600; 343/895

[56] References Cited

U.S. PATENT DOCUMENTS

| | | | |
|---|---|---|---|
| 3,371,410 | 3/1968 | Gintovt | 29/600 |
| 3,629,937 | 12/1971 | Fredriksson | 29/600 |
| 4,008,479 | 2/1977 | Smith | 343/895 |
| 4,894,628 | 1/1990 | Dadswell | 29/600 X |
| 5,081,469 | 1/1992 | Bones | 343/895 |

*Primary Examiner*—Carl J. Arbes
*Attorney, Agent, or Firm*—Koda and Androlia

[57] ABSTRACT

[Object] To provide a method of manufacturing a helical antenna for satellite communications which has no local bent, etc. in the completed helical coil even though the conductor wire used is of an extremely pliable material, so that a high-quality helical antenna for use in satellite communications is obtained.

[Structure] A winding frame 10 in which supporting elements 12 are projected in the form of a cross from the outer circumferential surface of a rod-form base 11 is first obtained. Wedge members 71 through 74, each of which having a configuration of a cylindrical body divided into four sections along its axis, are installed between the supporting elements 12. Then, with the cylindrical surfaces of the wedge members 71 through 74 being used as a winding guide, a conductor wire is wound in helical form through conductor wire installation grooves 13 formed on the edges of the supporting elements 12. Thus, a helical coil 20 is formed. Afterward, the wedge members are removed from the winding frame 10; as a result, an antenna element of a helical antenna suitable for satellite communication is obtained.

1 Claim, 6 Drawing Sheets

METHOD OF MANUFACTURING A HELICAL ANTENNA FOR SATELLITE COMMUNICATION

The present invention relates to a method of manufacturing a helical antenna used in satellite communications which is obtained by winding a conductor wire into helical form around a cylindrical or columnar shape winding frame.

PRIOR ART

One type of conventional helical antenna for satellite communications is obtained by coiling a conductive wire in a spiral groove which is formed in the outside circumferential surface of a relatively large diameter cylindrical winding frame that is made of a dielectric material.

Japanese Utility Model Application Laid-Open (Kokai) No. 3-32811 discloses another type of helical antenna. In this antenna, a multiple number of rectangular ribs are installed radially around the outer circumferential surface of a cylinder. Then, through-holes which are used for inserting a helical element are formed in the edge portions of the ribs, and a helical element which has been preformed into a shape of a coil (that is, a helical coil) is successively forced into the through-holes from its end.

In the antennas described first in the above, the winding pitch of the helical coil is determined by the positions of the spiral groove formed in the outside circumferential surface of the winding frame. Accordingly, helical coils of different pitches cannot be produced by the winding frame of the same (or single) model. Naturally, it is also impossible to obtain helical coils in different winding directions. Furthermore, since the helical coil is embedded in the winding frame that is made of a dielectric material of a prescribed dielectric constant, the dielectric constant of the dielectric material considerably affects the antenna characteristics.

In the antenna described secondly in the above, the helical element (or the helical coil) which has been formed into a coil shape beforehand is installed by being forced into, from its end, the through-holes formed in the edge portions of the rectangular ribs. As a result, it needs many winding processes, and the cost of the antenna tends to be high.

In order to eliminate the problems seen in the antennas described above, the inventors of the present application previously proposed a new helical antenna. This antenna includes a winding frame that is obtained from a rod-form base of a cylindrical or columnar shape and first to fourth supporting members each having a rectangular plate shape and being projected radially from four points of the outer circumferential surface of the rod-form base so that the supporting elements are respectively oriented on two planes which include the central axis of the rod-form base and intersect each other perpendicularly. In this antenna, the first and second grooves (used for conductor wire installation) are formed at a prescribed pitch in symmetrical positions in the respective outside edge portions of the first and second supporting elements, and the first and second supporting elements are provided so as to face each other in angular positions that differ by 180 degrees. The third and fourth grooves (used for conductor wire installation) are formed at a prescribed pitch which is shifted by ½ pitch from the pitch formed on the first and second grooves. The grooves are in symmetrical positions in the respective outside edge portions of the third and fourth supporting elements which face each other in angular positions that differ by 180 degrees and are shifted by 90 degrees from the angular positions of the first and second supporting elements.

According to the helical antenna as proposed above, helical coils with different winding directions, pitches and configurations can be obtained using the winding frames of the same model. In addition, it has a number of other merits. For example, the dielectric material for the winding frame has almost no effect on the antenna characteristics, the working characteristics of the winding operation are conspicuously improved so that the required winding work is greatly reduced, and the antenna can be manufactured at a low cost.

PROBLEMS THE PRESENT INVENTION ATTEMPTS TO SOLVE

However, the following problem remains unsolved in the helical antenna described above. More specifically, since the conductor wire is wound in grooves formed in the supporting elements which are assembled in a cross shape, bent portions, etc. tend to occur in the completed coil when the material of the conductor wire is pliable. This may lead to a quality drop of the antenna.

SUMMARY OF THE INVENTION

The present invention was made in light of the facts described above. The object of the present invention is to provide a method of manufacturing a helical antenna for satellite communications which can easily produce a high-quality helical antenna that is free of any local bent portions, etc. in the completed helical coil even when the conductor wire is made of an extremely pliable material.

In order to achieve the object, the following steps are adopted in the present invention. In the first step, a winding frame is obtained. The winding frame includes four supporting elements projected in the form of a cross from the outer circumferential surface of a rod-form base that is of a cylindrical or columnar shape. Each supporting element is shaped in a rectangular plate and is provided with grooves on the outer edge portion at a prescribed pitch so as to be used for installing a conductor wire therein. In the second step, wedge members are installed coaxially with the rod-form base so that they are between the adjacent supporting elements of the winding frame obtained by the first step. Each wedge member is obtained by dividing a cylindrical body into four sections along two planes which include the central axis of the cylindrical body and intersect each other perpendicularly. In the third step, a helical coil is obtained by winding a conductor wire in a helical configuration through the conductor wire installation grooves of the supporting elements which are located between the respective wedge members. In this winding step, the cylindrical surfaces of the wedge members are used as a winding guide. In the last and fourth step, the wedge members are removed from their locations which are between the helical coil and the winding frame after the helical coil has been formed in the third step.

As a result of the method described above, the following effects are obtained. During the formation of the helical coil, the conductor wire is wound in a helical form with the cylindrical surfaces of the wedge members used as a winding guide surface. Accordingly, the conductor wire is wound as if it is wound on the surface of a single cylindrical body. Thus, even if the material of the conductor wire is extremely pliable, the conductor wire is wound while being kept in an annular shape due to the cylindrical surfaces of the wedge members. Accordingly, an accurate cylindrical coil is obtained. Furthermore, external force that might be applied to the conductor wire during the formation of the helical coil will not cause any danger of the conductor wire being bent or broken. This is because the conductor wire is stably supported by the cylindrical surfaces of the wedge members.

DETAILED DESCRIPTION OF THE INVENTION

Figure 1:
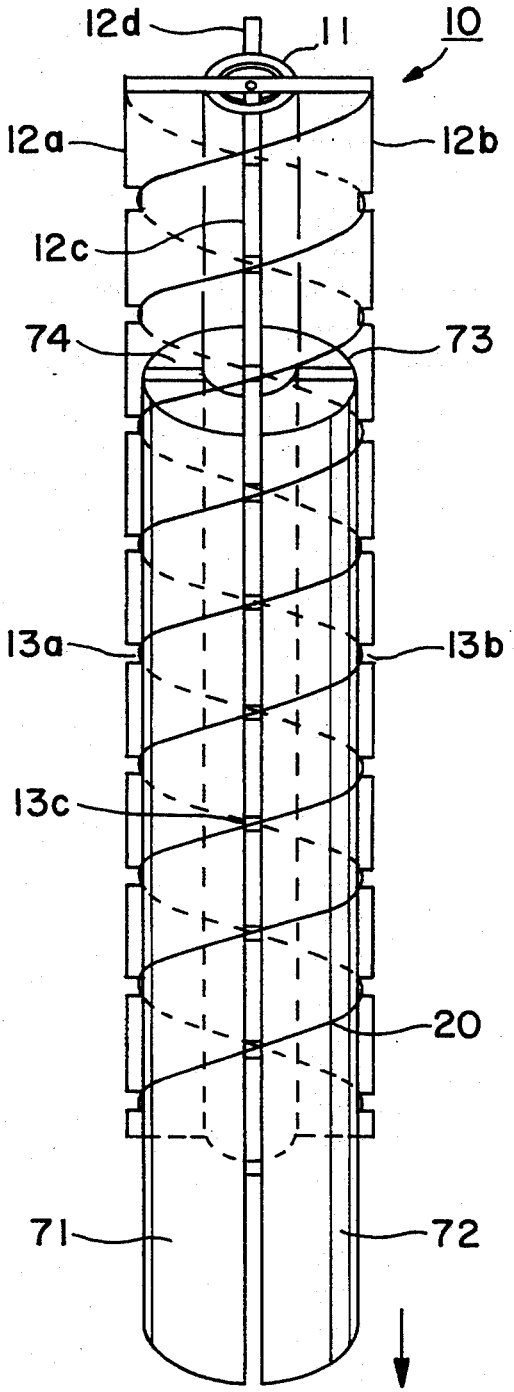
FIG. 1 is a perspective view of a helical antenna for satellite communication obtained by one embodiment of the manufacturing method of the present invention.
Figure 2A:
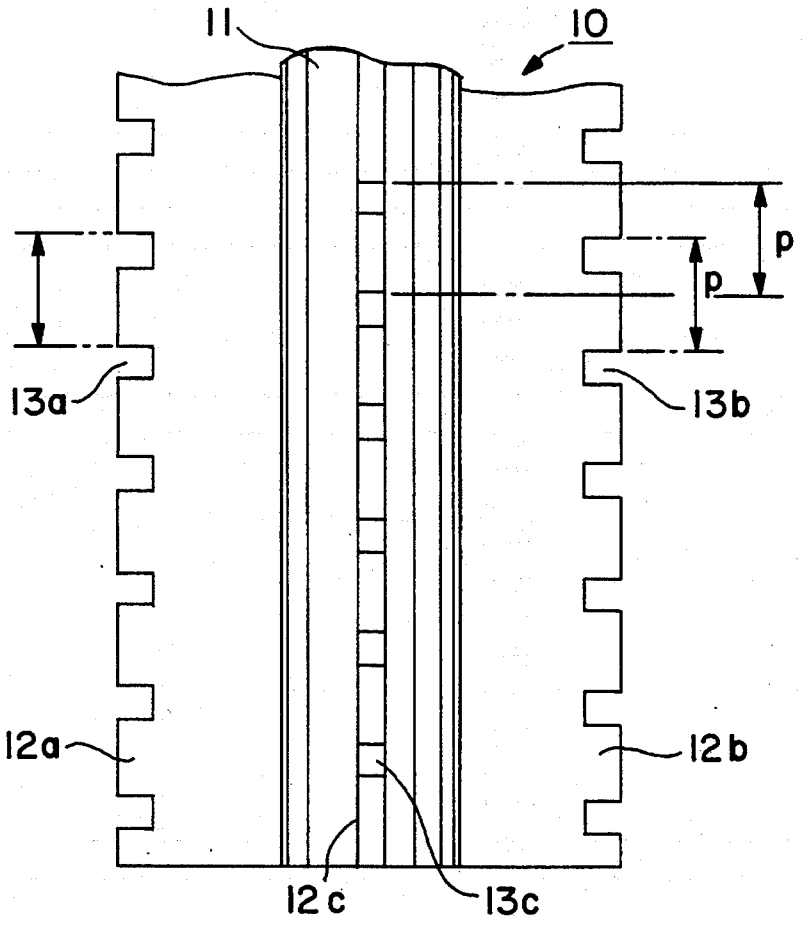
FIGS. 2(*a*) and (*b*) are a front view and an end view which illustrate the first helical antenna manufacturing process in the embodiment.
Figure 2B:
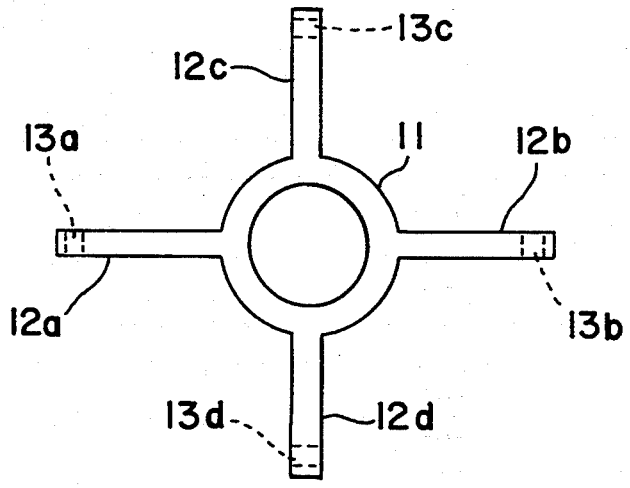

FIG. 1 is a perspective view of one embodiment of the method of the present invention for manufacturing a helical antenna for satellite communications (FIG. 1 shows the removal of the wedge members being initiated). FIGS. 2(*a*) and 2(*b*) through FIGS. 5(*a*) and 5(*b*) illustrate the manufacturing steps of the helical antenna in the embodiment. In each FIG., (*a*) is a front view and (*b*) is an end view.

As shown in FIG. 1, a winding frame 10 comprises four supporting elements 12*a* to 12*d*. These supporting elements 12*a* to 12*d* are projected from the outer circumferential surface of a rod-form base 11 so as to make a cross shape (when viewed from above). Four wedge members 71 to 74 are installed between the supporting elements 12*a* through 12*d*. Each wedge member has a configuration of a cylindrical body divided into four sections along the axis of the cylindrical body. Using the cylindrical surfaces of the wedge members 71 to 74 as a winding guide, a conductor wire is wound in a helical shape by being guided into conductor wire installation grooves 13*a* to 13*d* which are formed on the outer edge portions of the supporting elements 12*a* to 12*d*. Thus, a helical coil 20 is formed from the wound conductor wire. Afterward, the wedge members 71 to 74 are moved in the direction of the arrow and then removed from the winding frame 10 or from the area between the helical coil and the supporting elements. Thus, an antenna element of a helical antenna for satellite communications is obtained. In order to facilitate the removal of the wedge members, each one of the wedge members 71 to 74 has an appropriate taper portion in the axial direction.

The steps of manufacture of the helical antenna for satellite communications will be described below with reference to FIGS. 2(*a*) and 2(*b*) through 5(*a*) and 5(*b*).

In the first process, as shown in FIGS. 2(*a*) and 2(*b*), a winding frame 10 is prepared. The winding frame 10 includes first through fourth supporting elements 12*a* through 12*d*. Each of the supporting elements is of a rectangular plate shape. These supporting elements are assembled so that they project from the outer circumferential surface of a cylindrical rod-form base 11 so that the supporting elements are arranged in a cross shape when viewed from above.

The first through fourth supporting elements 12*a* through 12*d* project radially (in the form of a cross) from four locations of the outer circumferential surface of the rod-form base 11. Thus, the supporting elements 12*a* through 12*d* are respectively oriented on two planes which include the axis of the rod-form base 11 and intersect each other perpendicularly. The first and second conductor wire installation grooves 13*a* and 13*b* are formed at a prescribed pitch P in symmetrical positions in the respective outside edge portions of the first and second supporting elements 12*a* and 12*b* which are installed so as to face each other in angular positions that differ by 180 degrees. The third and fourth conductor wire installation grooves 13*c* and 13*d* are formed at a prescribed pitch P and at positions which are shifted by ½ pitch from the pitch P of the first and second grooves 13*a* and 13*b* in symmetrical positions in the respective outside edge portions of the third and fourth supporting elements 12*c* and 12*d*. The third and fourth supporting elements face each other in angular positions that differ by 180 degrees from each other and shifted by 90 degrees from the positions of the first and second supporting elements 12*a* and 12*b*.

Figure 3A:
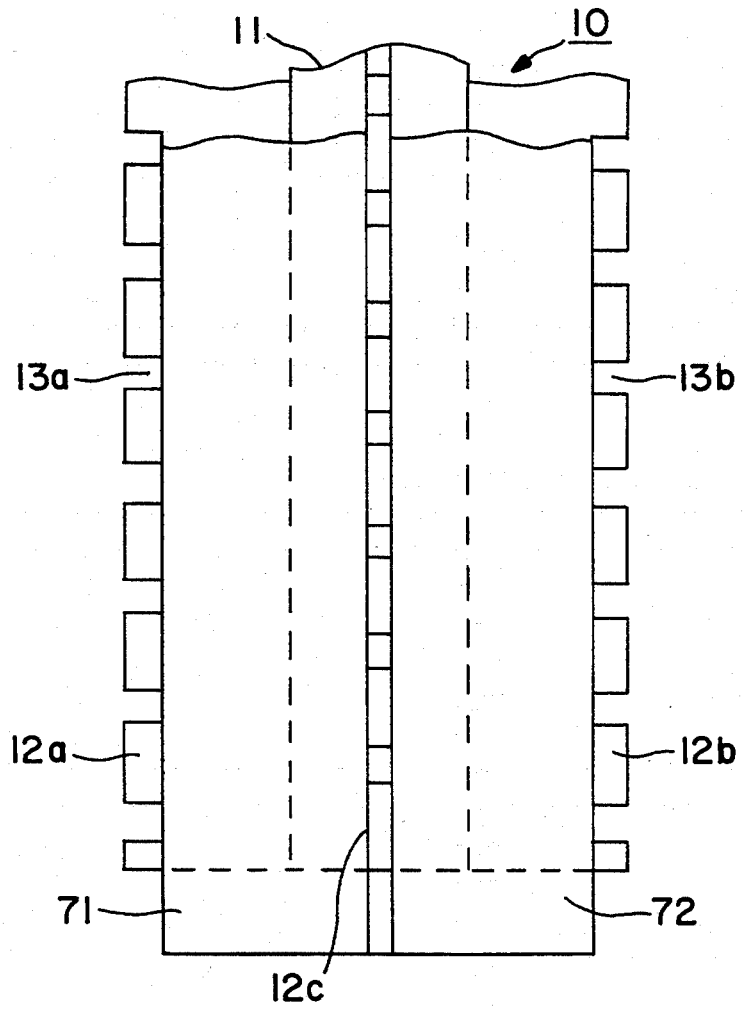
FIGS. 3(*a*) and (*b*) are a front view and an end view which illustrate the second helical antenna manufacturing process in the embodiment.
Figure 3B:
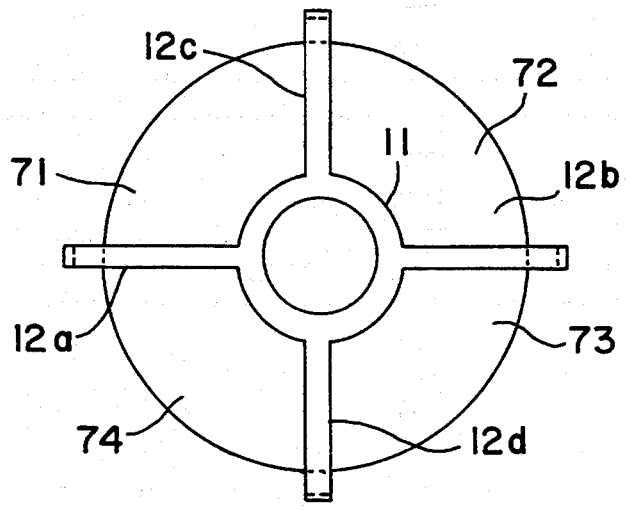
Figure 4A:
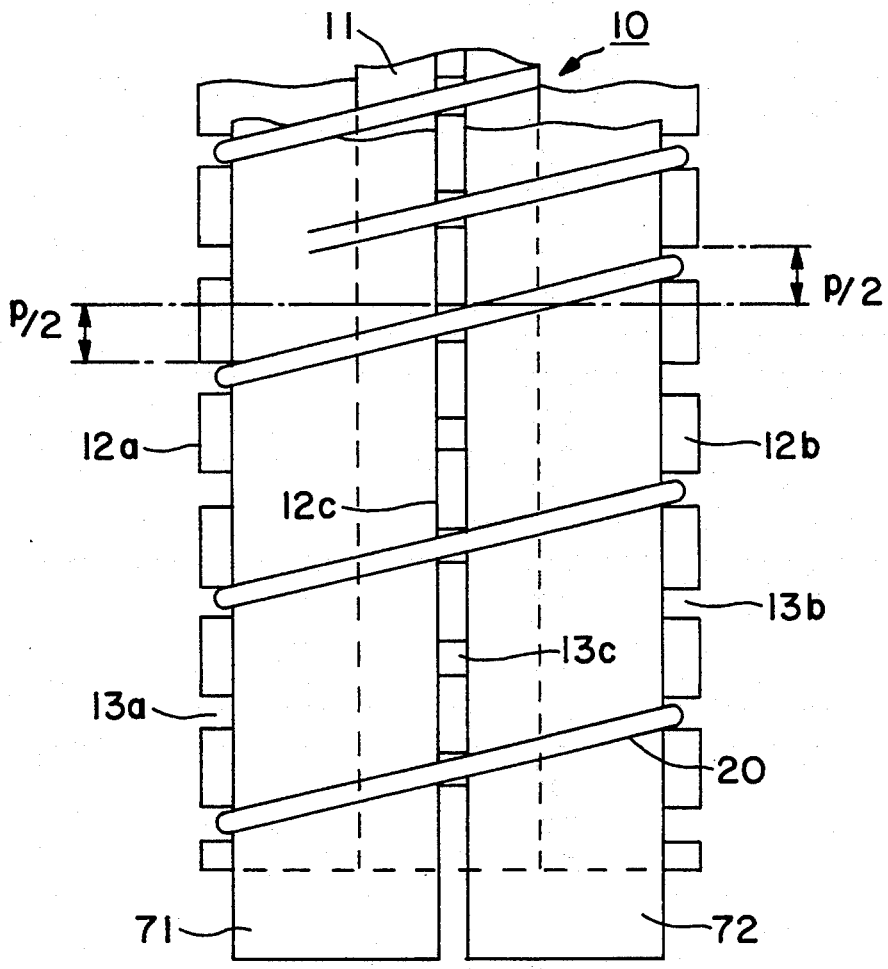
FIGS. 4(*a*) and (*b*) are a front view and an end view which illustrate the third helical antenna manufacturing process in the embodiment.
Figure 4B:
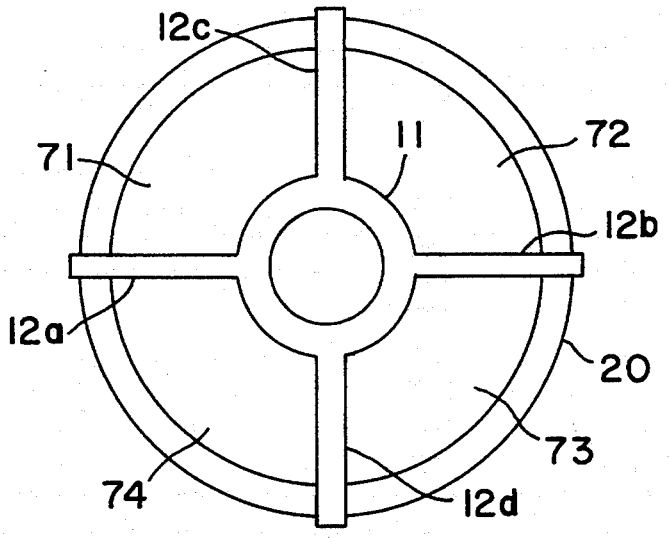

In the second process, as shown in FIGS. 3(*a*) and 3(*b*), wedge members 71 through 74 are installed coaxially with the base 11 body so that they are between adjacent supporting elements 12*a*–12*c*, 12*c*–12*b*, 12*b*–12*d*, 12*d*–12*a* of the winding frame 10 that is obtained in the first process. Each wedge member has a configuration obtained by dividing a cylindrical body into four sections along two (imaginary) planes which include the center axis of such a cylindrical body and intersect each other perpendicularly, In the third process, as shown in FIGS. 4(*a*) and 4(*b*), a conductor wire is wound in helical form in such a manner that the conductor wire is guided into the conductor wire installation grooves 13*a* through 13*d* of the supporting elements 12*a* through 12*d* which are located between the wedge members 71 through 74. In this winding process, the cylindrical surfaces of the wedge members 71 through 74 are used as a winding guide. The helical coil 20 is thus obtained.

The conductor wire installation grooves 13*a* through 13*d* on the outer edge portions of the supporting elements 12*a* through 12*d* are formed with a successive shift of ½ pitch at a time between adjacent supporting elements 12*a*–12*c*, 12*c*–12*b*, 12*b*–12*d*, 12*d*–12*a*, regardless of the direction of right-hand rotation or left-hand rotation about the axis. In other words, the grooves 13*a* through 13*d* correspond to the helical shape of the helical coil 20. Accordingly, the winding of the helical coil 20 may be in either the right-hand direction or the left-hand direction. In other words, the coil 20 may be a right-handed twinging coil 20 as shown in FIG. 4 or a left-handed twinging coil (not shown in the FIGS.). Thus, helical coils of different winding directions may be formed as desired using the same (or single) winding frame 10.

Which conductor wire installation grooves 13*a* should be used in the wire winding process may be chosen in accordance with the intended purpose. In other words, the winding pitch, etc. varies depending upon the selection of the grooves used in the winding of the conductor wire. Thus, the helical coils 20 are obtained in different pitches (for example, 2P, 3P, . . . ) or in different configurations (for example, a mixture of 1P and 2P, etc.) using the same or single winding frame 10.

Figure 5A:
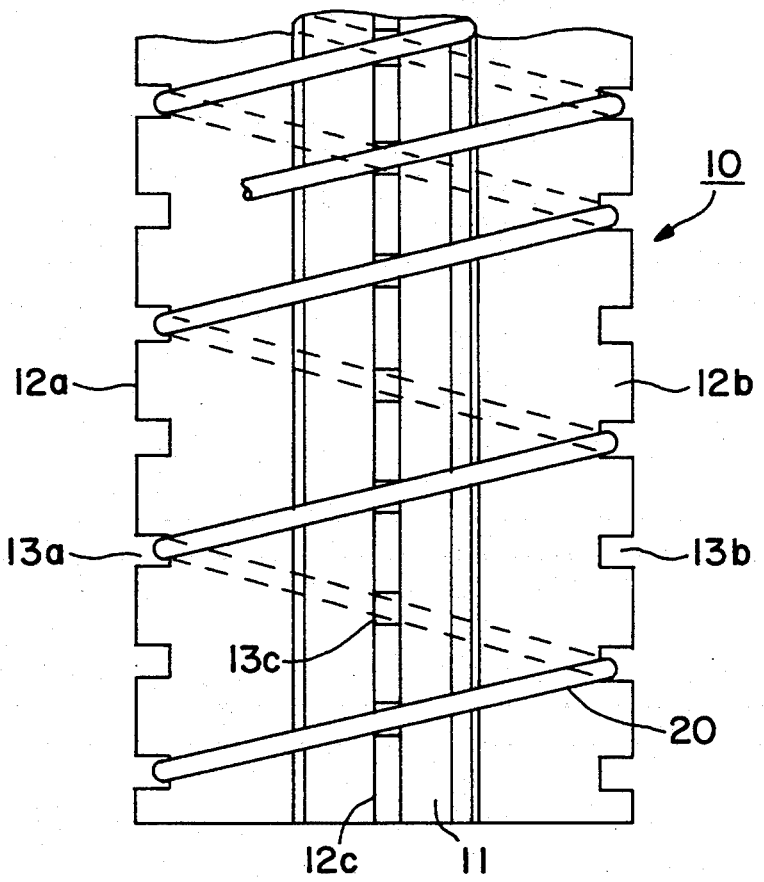
FIGS. 5(*a*) and (*b*) are a front view and an end view which illustrate the fourth helical antenna manufacturing process in the embodiment.
Figure 5B:
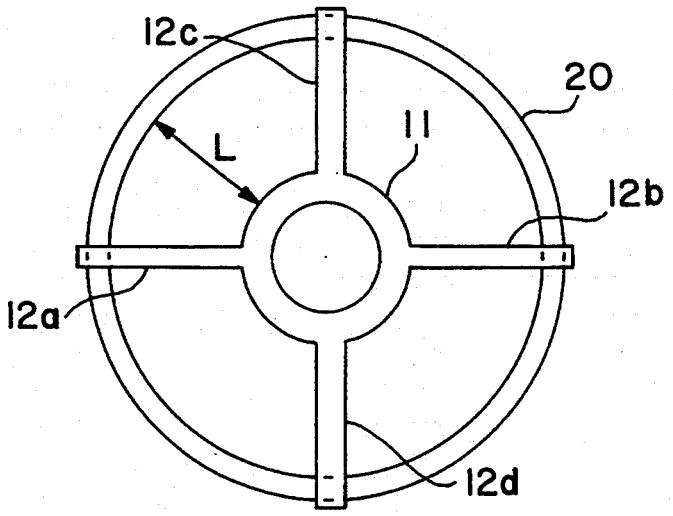

In the fourth process, as shown in FIGS. 5(*a*) and 5(*b*), the wedge members 71 through 74 are removed from winding frame or from the area between the helical coil 20 and the supporting elements after the helical coil 20 has been completed in the third process.

When the wedge members 71 through 74 have been removed, as shown in FIG. 5(*b*), the helical coil 20 is supported by the outside edge portions of the supporting elements 12*a* through 12*d*. Thus, the coil 20 is maintained at a prescribed distance L from the outside circumferential surface of the rod-form base 11. Accordingly, even if the dielectric material having a large dielectric constant is used for the rod-form base 11, the effect of this dielectric material on the antenna characteristics can almost completely be eliminated.

Figure 6:
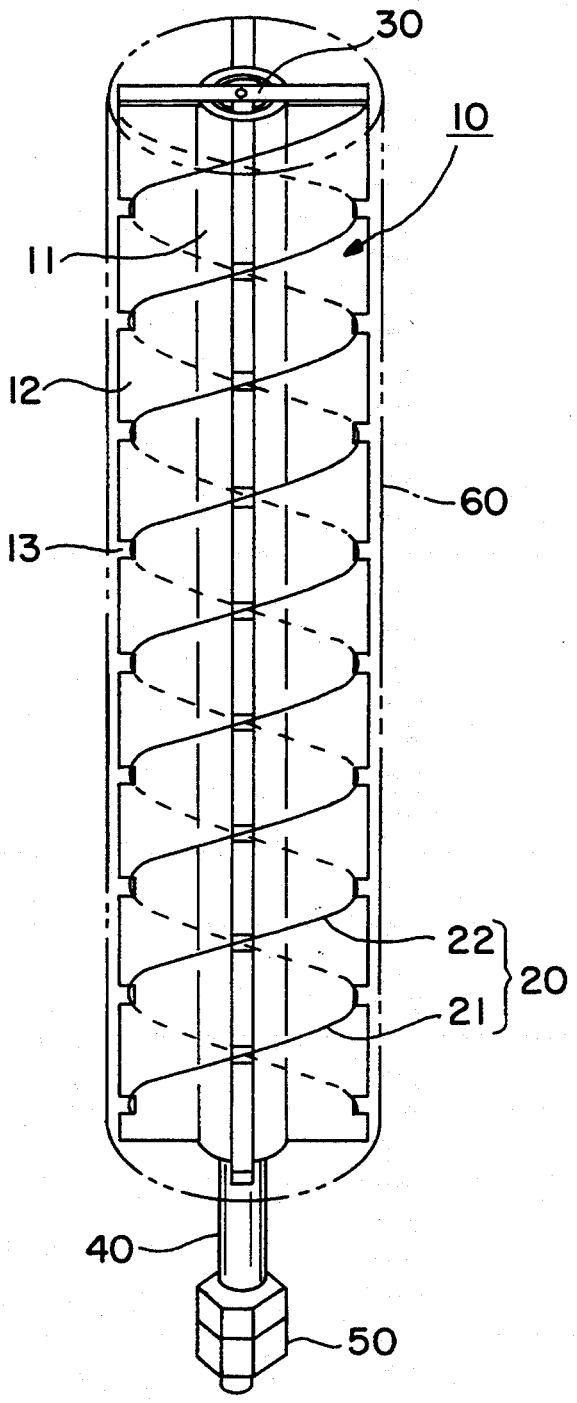
FIG. 6 is a perspective view of the external appearance of a completed helical antenna for satellite communications according to the embodiment of the present invention.

FIG. 6 is a perspective view of the external appearance of a completed helical antenna obtained via the first through fourth processes. As shown in FIG. 6, the conductor wire is wound in helical form around the winding frame 10, to make the helical coil 20. This helical coil 20 consists of first and second coils 21 and 22, each of which being wound a prescribed number of turns around a feeding point 30. The feeding point 30 is connected to the tip end of a coaxial cable 40 that passes through the rod-form base 11 of the winding frame 10. The base end of the coaxial cable 40 is extended from the bottom of the winding frame 10, and a coaxial cable connector 50 is connected to this extended base end. In use, the helical antenna is covered by a cover 60 that is shown by a one-dot chain line in FIG. 6.

The embodiment described above offers the following operating merits. First, during the formation of the helical coil 20, the conductor wire is wound in a helical form with the cylindrical surfaces of the wedge members 71 through 74 used as a winding guide. Accordingly, the conductor wire is wound as if the winding is performed on the surface of a cylindrical body. Thus, even if the material of the conductor wire used is, for example, extremely pliable, the conductor wire can be wound in an annular shape because of the cylindrical surfaces of the wedge members 71 through 74. Thus, an accurate cylindrical coil can easily be obtained. Furthermore, an external force applied to the conductor wire during the formation of the helical coil 20 does not affect the coil, and the conductor wire is not bent or broken, since the wire is stably supported by the cylindrical surfaces of the wedge members 71 through 74. Thus, the quality of the completed helical coil 20 can be conspicuously high.

The present invention is not limited to the embodiments above. The winding frame 10, for example, can consist of a multiple number of segment frames that are obtained by dividing a cylindrical frame into a multiple number of sections along the axis, and these segment frames are connected to each other. Furthermore, the rod-form base 11 and the supporting elements 12*a* through 12*d* can be separate members which are freely connectable. In addition, handles can be installed on the wedge members 71 through 74 in order to facilitate the removal of the wedge members. It goes without saying that various other modifications are available within the spirit of the present invention.

According to the method of the present invention for manufacturing a helical antenna, a winding frame is first obtained so that supporting elements are projected in the form of a cross from the outside circumference of a rod-form base. Next, wedge members, which have the configuration of a cylindrical body divided into four sections along its axial center, are installed between the supporting elements, and a conductor wire(s) is wound in helical form through the conductor wire installation grooves formed in the supporting elements. This winding of the conductor wire(s) is performed with the cylindrical surfaces of the wedge members being used as a guide. A helical coil is thus obtained. Afterward, the wedge members are removed from the winding frame. As a result, an antenna element of a helical antenna for use in satellite communications is obtained. Thus, because of the effect of the wedge members, the method for manufacturing a helical antenna of the present invention can provide a helical antenna which has no local bent, etc. that might occur in the completed helical coil even though the material of the conductor wire used is an extremely pliable. Thus, with the method of the present invention, a high-quality helical antenna for use in satellite communications can be obtained.

We claim:

1. A method of manufacturing a helical antenna for satellite communication comprising:

obtaining a winding frame, said winding frame being obtained via four supporting elements projecting in a cross shape from an outer circumferential surface of a cylindrical base, each one of said four supporting elements being of a rectangular plate shape and being provided with conductor wire grooves at a prescribed pitch formed on an outer edge of said supporting element;

installing wedge members between adjacent supporting elements of said winding frame coaxial with said cylindrical base, each one of said wedge members having a configuration formed by dividing a cylindrical body having an axial taper into four sections along two planes which include a center axis of said cylindrical base and intersect each other perpendicularly;

winding a conductor wire in a helical configuration through said conductor wire grooves of said four supporting elements which are located between said wedge members cylindrical surfaces of said wedge members being used as a winding guide; and removing said wedge members from locations between said helical coil and said winding frame after said helical coil has been formed by withdrawing said wedge members in a direction opposite to said axial taper.

* * * * *